United States Patent [19]

Merryman

[11] Patent Number: 4,532,579

[45] Date of Patent: Jul. 30, 1985

[54] ILLUMINATED INTERCONNECTABLE SIGN MODULE

[76] Inventor: Bill Merryman, 7752 Finns La., Apt. C1, Lanham, Md. 20706

[21] Appl. No.: 600,018

[22] Filed: Apr. 13, 1984

[51] Int. Cl.[3] ..... F21V 11/04

[52] U.S. Cl. ..... 362/239; 362/248; 362/367; 362/812; 362/285; 362/429; 362/310; 362/457; 40/452; 40/552; 40/508; 40/576; 40/596

[58] Field of Search ..... 362/29, 154, 236, 367, 362/429, 457, 812, 239, 248, 812; 40/152.2, 452, 508, 509, 530, 531, 552, 575, 576, 596, 618, 628

[56] References Cited

U.S. PATENT DOCUMENTS

| | | | |
|---|---|---|---|
| 1,192,982 | 8/1916 | Bristol et al. | 40/552 |
| 1,462,156 | 7/1923 | Trucksess | 40/130 |
| 1,760,767 | 5/1930 | Muller | 40/130 |
| 1,782,564 | 11/1930 | Coufal et al. | 362/812 X |
| 1,784,677 | 12/1930 | Morton | 362/812 X |
| 2,424,169 | 7/1947 | Hoffman | 35/35 |
| 2,499,049 | 2/1950 | Yates | 40/130 |
| 2,520,243 | 8/1950 | Hoffman | 40/130 |
| 2,623,315 | 12/1952 | Owen et al. | 40/552 |
| 3,238,654 | 3/1966 | Rosenak et al. | 362/812 X |
| 3,553,870 | 1/1971 | Rudolph | 40/130 |
| 3,822,487 | 7/1974 | Kock | 40/620 X |
| 3,842,523 | 10/1974 | Yumoto | 40/508 X |
| 3,968,584 | 7/1976 | Kingston | 362/812 X |
| 4,028,828 | 6/1977 | Chao et al. | 40/130 D |
| 4,070,779 | 1/1978 | Gilmour | 40/575 |
| 4,223,377 | 9/1980 | Williams | 362/145 |
| 4,254,457 | 3/1981 | Lordier | 362/812 X |
| 4,303,969 | 12/1981 | Hamilton et al. | 362/153 |
| 4,340,929 | 7/1982 | Konikoff et al. | 362/153 |

FOREIGN PATENT DOCUMENTS

| | | | |
|---|---|---|---|
| 516078 | 1/1931 | Fed. Rep. of Germany | 40/552 |
| 725694 | 11/1931 | France | 40/552 |

*Primary Examiner*—Peter A. Nelson
*Attorney, Agent, or Firm*—Stephen F. K. Yee

[57] ABSTRACT

An illuminated module connectable with similar modules to form an illuminated sign, especially an address or like location sign, comprises an enclosure for an illumination source having an indicia-bearing surface and a plurality of electrical and mechanical interconnecting means on at least two surfaces to permit the assembly of adjacent modules into different configurations.

20 Claims, 10 Drawing Figures

ILLUMINATED INTERCONNECTABLE SIGN MODULE

BACKGROUND OF THE INVENTION

1. Field of the Invention

The present invention relates generally to illuminated signs, and more particularly to such signs assembled from individual interconnectable modules. More specifically, the invention relates to an illuminated address or similar location sign formed of a plurality of joined illuminated modules, each module having interconnecting structure which permits joining of the modules in other than a straight line configuration.

2. The Prior Art

Most address signs comprise numbers and alphabetic characters which are small in size and difficult to see. Highly visible and legible signs would be convenient for anyone looking for an address, and in the case of an emergency vehicle responding to a call, the ability to quickly and accurately locate an address could be critical.

The few address signs which have easy-to-see illuminated characters are generally custom-made and are expensive. Illuminated signs or displays which use individual, illuminated characters are known, such as those disclosed in the following U.S. Pat. Nos.:

| | | |
|---|---|---|
| 1,462,156 | Trucksess | July 17, 1923 |
| 1,760,767 | Muller | May 27, 1930 |
| 1,782,564 | Coufal et al. | Nov. 25, 1930 |
| 1,784,677 | Morton | Dec. 9, 1930 |
| 2,424,169 | Hoffman | July 15, 1947 |
| 2,499,049 | Yates | Feb. 28, 1950 |
| 2,520,243 | Hoffman | Aug. 29, 1950 |
| 3,553,870 | Rudolph | Jan. 12, 1971 |
| 4,028,828 | Chao et al. | June 14, 1977 |

With the exception of the patent to Muller, the other patents disclose displays having a support with one or more pairs of electrical conductors, with the individual characters placed in the desired location in a straight line and making electrical contact with the conductors to energize the bulb or bulbs therein. The individual characters are generally slidable along the straight-line display to permit a degree of flexibility in the positions of the characters and differences in the width of each character. The two patents to Hoffman provide for pre-positioned holes to receive the contact elements of each character.

Of the foregoing patents, those to Coufal et al., Yates and Chao et al. provide electrical interconnecting structure on each character such that the electrical circuit is completed through physical and electrical contact between adjacent characters, much like a series circuit. Spaces between letters or words are provided by character units having blank or opaque faces. All the characters are connected in a straight line to form the words on the display.

The patent to Muller discloses individual cubes of translucent material, each having a self-contained light source and electrical connection, which can be stacked or otherwise assembled into different configurations. Since each cube is independently lit, there is no interconnecting electrical or mechanical structure between the cubes.

U.S. Pat. No. 4,223,377, to Williams, U.S. Pat. No. 4,303,969, to Hamilton et al. and U.S. Pat. No. 4,340,929, to Konikoff et al., although not related directly to display signs, describe illuminated units which can be joined in straight, horizontal lines or straight, vertical lines. Williams discloses illuminated bricks provided with electrical connectors at each end to permit joining the brick, mechanically and electrically, end to end. Similar connectors on the top and bottom surfaces permit stacking of the bricks. Hamilton et al. and Konikoff et al. disclose portable floor sections with illuminated top surfaces and having electrical connectors on the side surfaces to permit electrical coupling of the sections horizontally and vertically in straight lines.

While the foregoing patents show the joining in a straight line, vertically and horizontally, of individual units which can be illuminated with internal sources, with interconnecting electrical connectors, these units can not be assembled into other configurations, such as on a diagonal, staggered or a zig zag pattern. In address signs in particular, the capabiilty of such alternate arrangements enhances the visual appearance and appeal of the sign.

SUMMARY OF THE INVENTION

Accordingly, among the objects of the present invention are to provide: an illuminated sign module which is connectable with other similar modules to form a sign, and in particular, an address sign; a module of this type which can be interconnected with other similar modules in a straight-line arrangement, vertically and horizontally, as well as on a diagonal, staggered, zig zag, or other similar arrangements; and a module of this type having a self-contained illumination source and at least one light-transmissive surface which is interchangeable to permit changing the light-transmissive quality or the color of the surface, or to change the size and type of character on the face of the surface.

These and other objects of the invention are achieved with an illuminated, interconnectable sign module having an illumination source disposed within an enclosure and coupled to at least two sets of electrical receptacle devices disposed on each of two surfaces of the enclosure through which an electrical interconnection couples the illumination source to an electrical source, the enclosure having at least one light-transmissive surface which can be removed and replaced with another surface to change the light-transmitting capability of the module, to change the color of the surface, or to change the indicia on the face of the surface.

An electrical connector device is received within a set of receptacle devices on each adjacent surface of adjoining modules to permit individual modules to be joined or separated. Additional mechanical interconnections may be provided to ensure a stable assembly of the modules.

At least two, and preferably more, complete sets of electrical receptacle devices are provided on two, oppositely-disposed surfaces, such that each set of connectors forms a complete electrical circuit when suitably coupled to an electrical source. Multiple sets of receptacle devices permit the selective joining of any one set to assemble plural modules into configurations other than straight-line horizontal or straight-line vertical. Preferably, sets of electrical receptacle devices are provided on all of the surfaces of the enclosure to provide maximum flexibility in arranging and assembling a plurality of the modules into different configurations. Plugs seal the receptacle sets which are not used to electrically or mechanically interconnect modules.

BRIEF DESCRIPTION OF THE DRAWINGS

The above description, as well as further objects, features and advantages of the invention, will be apparent by reference to the following description of a presently-preferred but nonetheless illustrative embodiment in accordance with the invention, when considered together with the accompanying drawings, in which like reference numerals indicate corresponding or similar parts, wherein.

DETAILED DESCRIPTION OF THE PREFERRED EMBODIMENT

Figure 1:
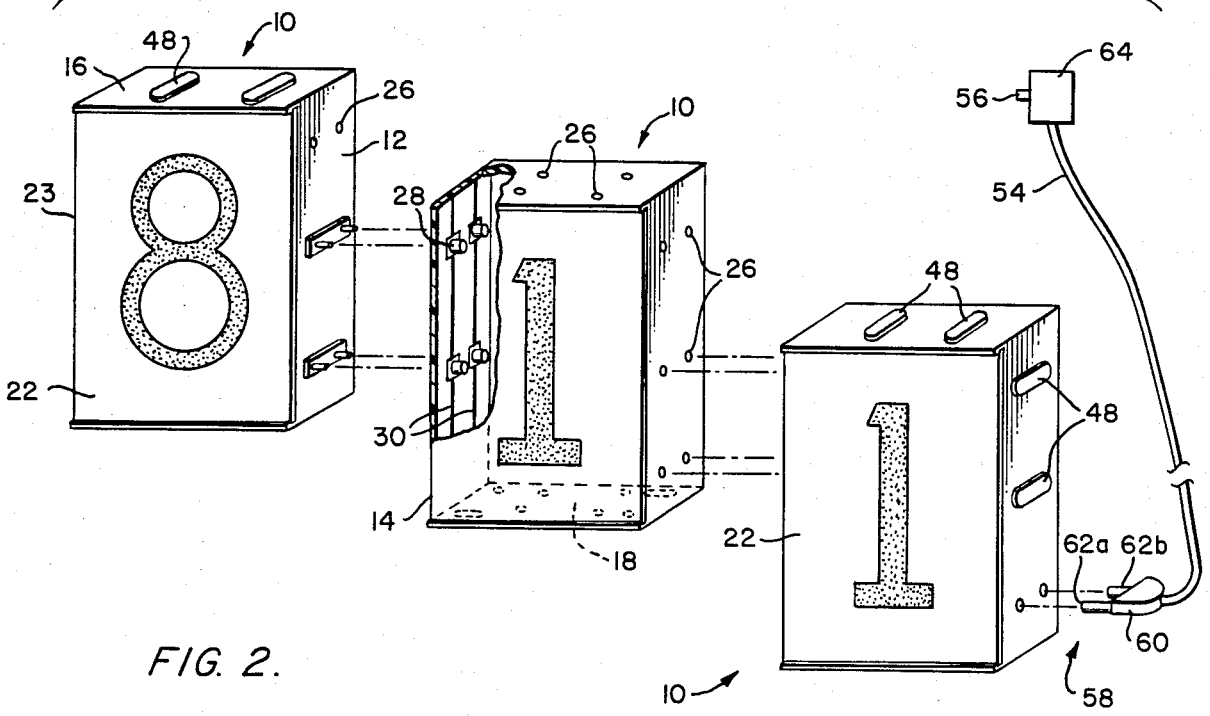
FIG. 1 is a front perspective view of several sign modules according to the present invention being assembled into one of several possible configurations, with one of the modules sectioned to show a portion of its interior.
Figure 2:
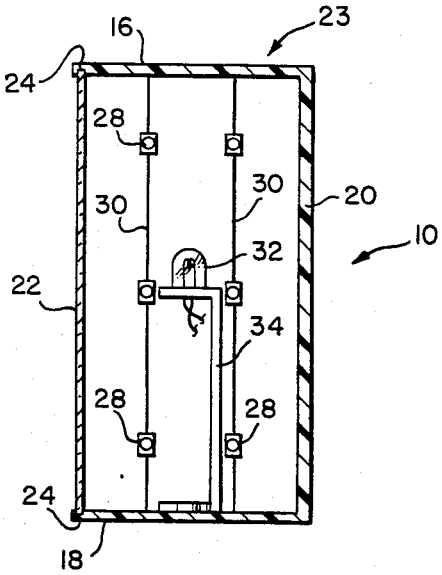
FIG. 2 is a side, cross-sectional view of one of the modules shown in FIG. 1.

Referring now to FIGS. 1 and 2, an illuminated interconnectable sign module or unit 10 according to the present invention includes parallel-disposed sides 12 and 14, top 16, bottom 18, back 20 and a front or face panel 22 joined together to form an enclosure 23. To facilitate easy removal and replacement of the front panel 22, a groove or channel 24 is provided adjacent to the free edge of each of the top 16, bottom 18 and one of the sides, such as side 14. The aligned grooves in these surfaces provide a guide or track in which the front panel 22 is slidably received.

The side, top, bottom and back panels forming the enclosure 23 may be made of any suitable material which is opaque to light transmission, such as plastic, metal, wood, or the like. The front panel 22 is preferably of a translucent or transparent material, such as plastic or glass. The back panel 20 may be provided with slots, holes or similar openings (not shown) to permit hanging of the enclosure from a wall or other support surface.

The front panel 22 is provided with a character, such as a number or a letter, in any suitable fashion, such as by painting the character directly on the surface, applying a decal of the character, cutting the character out from the front panel, or attaching a separately-formed character onto the surface of the panel. If the character is cut out from the front panel 22, it is preferred that a backing be applied to the back surface of the panel to prevent entry of moisture or dirt into the enclosure of the module 10. The front panel 22 may be of any color, with the characters being of a dark or a contrasting color which will enhance visibility of the character against the backdrop of the illumination emanating from the interior of the enclosure 23, as described more fully below. Alternatively, the front panel 22 may be of an opaque material and the character cut out of the surface such that the illumination would shine through the cutout.

As shown in FIG. 1, each of the sides 12 and 14, top 16 and bottom 18 is provided with several sets of openings or apertures 26 extending completely through the panel. Preferably at least two sets of apertures are provided on each panel, and FIG. 1 shows three sets being provided for the longer sides 12 and 14. The apertures in each set 26 are appropriately spaced laterally from each other and suitably located on the respective panels.

An electrically conductive receptacle element or contact 28 is aligned with each of the apertures 26, on the inside surface of each of the enclosure panels. Any known female-type electrical contact elements may be used, and the contacts are electrically connected in parallel by conductors 30.

Figure 3:
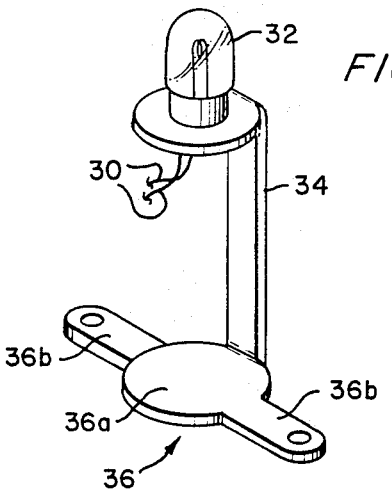
FIG. 3 is a perspective view of the bracket which supports the illumination source within a module.
Figure 4:
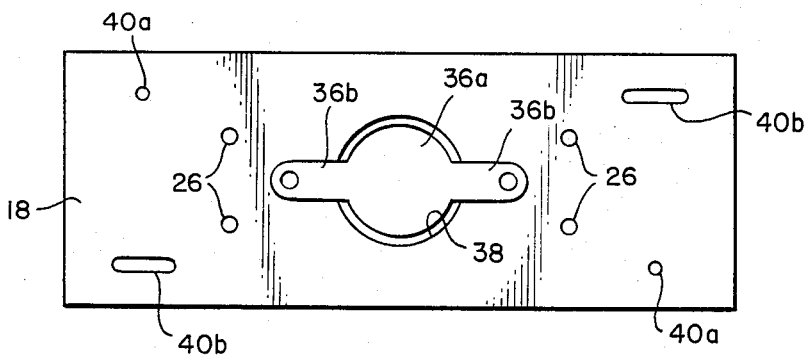
FIG. 4 shows the bottom surface of a module.
Figure 7B:
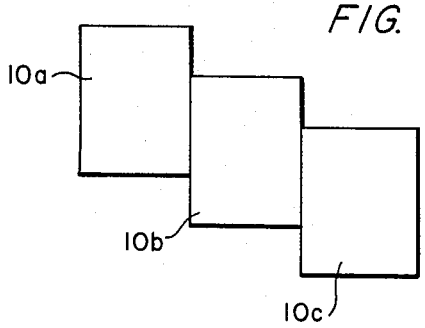
Figure 7A:
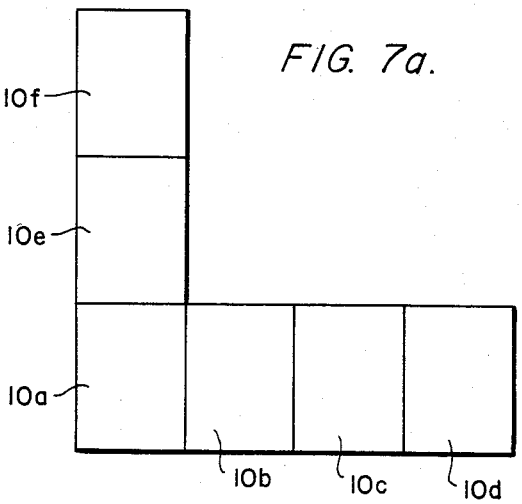
Figure 7C:
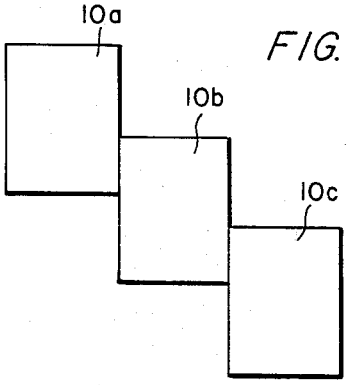
Figure 7D:
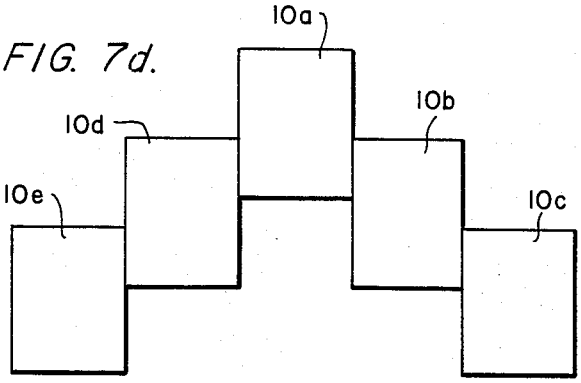

As shown in FIGS. 2 and 3, an illumination source 32 is mounted on a bracket 34 supported on the inner surface of the bottom panel 18 and is electrically connected to the conductors 30. The bracket 34 is made of a dielectric material and is detachably supported on the bottom panel 18 by a base 36, to permit removal of the bracket for replacement of the illumination source 32. The bracket base 36 has a central disk-like portion **36*a* and coplanar oppositely-extending tabs 36*b*. The bottom panel 18 has a cutout 38 (FIG. 4) through which the upper portion of the bracket 34 and the illumination source 32 are inserted. As shown in FIG. 4, the central disk 36*a* substantially closes the cutout 38, and the bracket 34 is secured to the bottom panel 18, such as with screws extending into the panel through holes provided in the tabs 36*b***.

To enhance the illumination provided by the source 32 and to direct the light toward the front panel 22, a reflective coating or layer may be applied to the inner surfaces of the enclosure 23, except the front panel.

Also shown in FIG. 4 are the drainage openings in the bottom panel 18, such as holes **40*a* or slots 40*b*, to permit removal of moisture which may have accumulated within the module 10**. A combination of holes and slots may be provided as shown, or only one type of drain openings may be used.

Figure 5:
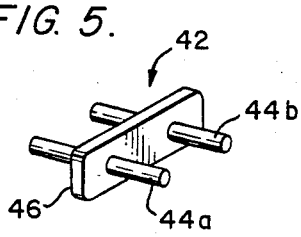
FIG. 5 is a perspective view of a connector for joining together several modules.

Electrical coupling of two or more modules 10 is achieved with a connector 42 which, as shown in FIG. 5, includes a pair of electrically conductive pins **44*a* and 44*b* extending through a support member 46 of dielectric material. The support member 44 properly spaces the pins 42*a*, *b* and facilitates manipulation of the connector 42**.

Mechanical coupling of multiple modules, in addition to the mechanical coupling achieved in part with the electrical connector 42, may be made with a mechanical connector (not shown) which is substantially identical structurally to the electrical connector 42, except that the conductive pins **44*a*, *b*** are replaced with pins or rods of dielectric material. One or more such mechanical connectors may be inserted into the aligned sets of apertures on adjacent enclosure surfaces.

Figure 6:
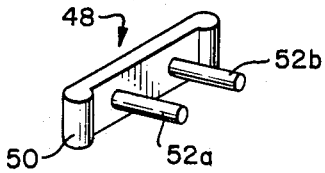
FIG. 6 is a perspective view of a closure plug used to seal the interconnecting apertures in a module; and FIGS. *7a–7d* diagramatically illustrate different configurations into which a plurality of modules may be assembled.

The apertures 26 which are not used for electrical or mechanical interconnection are closed with a plug 48, such as shown in FIG. 6, made of a dielectric material and having a cap 50 and pegs **52*a*, *b* extending therefrom, separated a distance corresponding to the spacing of the apertures 26. By way of illustration, the cap 50 may be made of a flexible, resilient dielectric material for increased sealing of the apertures 26, and the pegs 52*a*, *b*** may be made of a harder dielectric material for ease of insertion of the cap.

Electrical power is provided to the module 10, or an assembly of modules, by a power line 54, such as shown in FIG. 1, which has a conventional plug 56 at one end for connection to a power source and a module power plug 58 at the other end. The module power plug 58 resembles the electrical connector 42 shown in FIG. 5, and has a body portion 60 of dielectric material, with a pair of electrically-conductive plug pins or prongs 62*a, b* extending therefrom which are inserted into a set of apertures 26 in the module 10. A control switch (not shown) may be incorporated in the power line 54 to turn the illumination sources 52 on and off. Alternatively, a photocell-type device (not shown) of known construction may be provided to turn the illumination source on and off in response to ambient light conditions. The photocell controller may be provided with electrically-conductive prongs which are compatible with the apertures 26 on the module 10 so that it may be mounted on the module, with the power plug 58 being inserted into the photocell controller. While this arrangement provides greater flexibility, the photocell controller and power plug may be incorporated into a single unit connected directly to the end of the power line 54.

A low-voltage electrical power system may be used with the module 10, and for this purpose a transformer 64 of known construction (FIG. 1) may be incorporated into the power line 54 to reduce the power source voltage. It is understood, of course, that the transformer 64, as well as the photocell controller, may be provided anywhere along the power circuit to the illumination source.

FIGS. *7a–7d* illustrate some of the configurations into which a plurality of the modules 10 may be assembled. In FIG. *7a*, several modules are arranged in a horizontal, straight line and a vertical, straight line. The horizontal arrangement results from interconnecting electrically one of the sets of apertures 26 on the sides of adjacent modules 10*a*–10*d*, and the vertical arrangement results from interconnecting one of the sets of apertures of abutting top and bottom panels of superposed modules 10*a* and 10*e*–10*f*. For maximum stability, the remaining apertures in the adjoining module surfaces may be interconnected with non-conductive structural connectors described above. It is apparent from FIG. *7a* that additional modules may be connected to those shown to produce other arrangements.

The arrangement shown in FIGS. *7b* and *7c* result from interconnecting several modules in a staggered, or zigzag, fashion, such as by connecting the uppermost set of apertures on the left side of module 10*b* to the middle set of apertures on the right side of module 10*a*, and repeating this arrangement for modules 10*b* and 10*c*. Similarly, by connecting the uppermost aperture set on the left side of module 10*b* to the lowest aperture set on the right side of module 10*a*, etc., results in the configuration shown in FIG. *7c*. Instead of staggering downwardly to the right as shown in FIGS. *7b, c*, the staggering may be up to the right, down to the left, or up and down, as shown in FIG. *7d*, or any combination thereof.

Combinations are possible of the arrangements shown in FIGS. *7a–7d*, as well as many others in view of the illustrations. It can be seen that by providing at least two sets and preferably more, of apertures on each surface of the module which can be abutted against another module, great flexibility results in the different ways in which modules can be assembled. It can be further appreciated that even greater flexibility can be achieved by providing additional sets of apertures on the module surfaces.

Various modifications of the invention are possible in view of this disclosure. For example, and by way of illustration and electrical interconnection means may be used, and other, additional means provided to mechanically and electrically join together plural modules. Other geometric configurations may be used for the module enclosures.

Although not described herein, additional variations of the specific construction and arrangement of the module disclosed above can be made by those skilled in the art without departing from the scope of the invention as defined in the appended claims.

What is claimed:

1. An illuminable module connectable with one or more substantially similar modules in a linear or non-linear, zigzag arrangement, said module comprising:

an enclosure with at least one surface having a portion capable of transmitting light therethrough;

an illumination source in said enclosure;

at least two electrically-conductive receptacle devices provided on a light non-transmitting surface of said enclosure, said devices being electrically coupled to said illumination source, each of said devices capable of completing an energizing circuit for said illumination source independently of the other device;

an electrically-conductive connector removably received within any one of said receptacle devices to electrically interconnect the illumination source with an adjacent similar module; and electrical power means connectable to said illumination source through one of said receptacle devices to energize said source, said module connectable with one or more adjacently-disposed similar modules in a linear arrangement by interconnecting with said connector one of said receptacle devices of said module with the corresponding, aligned receptacle device of the adjacent module such that the adjacent module enclosures are linearly arranged horizontally or vertically, or in a non-linear, zigzag arrangement by interconnecting with said connector one of the receptacle devices of adjacent modules such that the adjacent module enclosures are not linearly aligned.

2. A module as defined in claim 1, wherein at least two receptacle devices are provided on each of two light non-transmitting surfaces of said enclosure.

3. A module as defined in claim 2, wherein said two light non-transmitting surfaces are parallel, oppositely-disposed surfaces.

4. A module as defined in claim 1, wherein each light non-transmitting surface of said enclosure is provided with at least two receptacle devices.

5. A module as defined in claim 1, wherein the surface of said enclosure having a light-transmitting portion is provided with an indicia or character.

6. A module as defined in claim 5, wherein said surface having a light-transmitting portion is removable from said enclosure.

7. A module as defined in claim 1, wherein the interior surfaces of said module, other than the surface having a light-transmitting portion, are provided with a light-reflective layer.

8. A module as defined in claim 1, further comprising an electrically non-conductive connector element removably received within any one of said receptacle devices to mechanically interconnect adjacent modules.

9. A module as defined in claim 1, further comprising a cap member removably received in any one of said receptacle devices to cover said receptacle device.

10. An illuminable display formed from an assembly of two or more individual modules electrically connected together, each module comprising;

an enclosure with at least one surface having a light-transmissive portion and an indicia or character on said portion;

an illumination source disposed within said enclosure;

at least two electrically-conductive receptacle devices provided on a light non-transmissive surface of said enclosure, said devices being electrically coupled to said illumination source, each of said devices capable of completing an energizing circuit for said illumination source independently of the other device, said surface having said receptacles devices being adjacently disposed surfaces when the modules are assembled;

an electrically-conductive connector removably received within any one of said receptacle devices to electrically interconnect the illumination source in each adjacent module; and electrical power means connectable to said illumination source through one of said receptacle devices to energize said source, the modules forming said display being assembled in a linear arrangement by interconnecting with said connector one receptacle device of a module with the corresponding, aligned receptacle device of the adjacent module such that the module enclosures are linearly assembled horizontally or vertically, or in a non-linear, zigzag arrangement by interconnecting with said connector the receptacle devices of adjacent modules such that the assembled module enclosures are not linearly aligned.

11. A display as defined in claim 10, wherein at least two receptacle devices are provided on each of two light non-transmitting surfaces of said enclosure.

12. A display as defined in claim 10, wherein said two light non-transmitting surfaces are parallel, oppositely-disposed surfaces.

13. A display as defined in claim 10, wherein each light non-transmitting surface of said enclosure is provided with at least two receptacle devices.

14. A display as defined in claim 10, wherein said surface having a light-transmitting portion is removable from said enclosure.

15. A display as defined in claim 10, wherein the interior surfaces of said module, other than the surface having a light-transmitting portion, are provided with a light-reflective layer.

16. A display as defined in claim 10, further comprising an electrically non-conductive connector element removably received within any one of said receptacle devices to mechanically interconnect adjacent modules.

17. A display as defined in claim 10, further comprising a cap member removably received in any one of said receptacle devices to close said receptacle device.

18. A display as defined in claim 17, wherein said cap member comprises a resilient surface and a dielectric element extending from said surface, said dielectric element being receivable in said receptacle device and said resilient surface covering said receptacle device.

19. A display as defined in claim 10, further comprising support means removably disposed in said enclosure, said illumination source being supported on said support means.

20. A display as defined in claim 10, wherein said electrically-conductive connector comprises a conductive element supported on a dielectric piece, one end of said conductive element being receivable in a receptacle device on one of said modules and the other end of said conductive element being receivable in a receptacle device on the adjacent module.

* * * * *

UNITED STATES PATENT AND TRADEMARK OFFICE

CERTIFICATE OF CORRECTION

PATENT NO. : 4,532,579
DATED : 30 July 1985
INVENTOR(S) : Bill Merryman

It is certified that error appears in the above-identified patent and that said Letters Patent are hereby corrected as shown below:

Column 5, line 17, "with the power plug 58 being" should read --with the module power plug 58 being--;

Column 6, line 3, after "illustration" the following should be inserted: --only and not by way of limitation, other electrical power--; and Claim 12, line 1, "A display as defined in claim 10" should read: --A display as defined in claim 11--.

Signed and Sealed this

*Twenty-sixth* Day of *November 1985*

[SEAL]

*Attest:*

DONALD J. QUIGG

*Attesting Officer*

*Commissioner of Patents and Trademarks*